US005794371A

United States Patent [19]

Camillery

[11] Patent Number: 5,794,371

[45] Date of Patent: Aug. 18, 1998

[54] PICTURE FRAME SYSTEM

[76] Inventor: Grace Camillery, 3 Croydon Dr., Bellmore, N.Y. 11710

[21] Appl. No.: 779,319

[22] Filed: Jan. 6, 1997

[51] Int. Cl.[6] ..... G09F 1/12

[52] U.S. Cl. ..... 40/717; 40/455; 40/753

[58] Field of Search ..... 40/455, 717, 753; 312/7.2; 248/917, 918

[56] References Cited

U.S. PATENT DOCUMENTS

| | | | |
|---|---|---|---|
| D. 255,745 | 7/1980 | Pedersen | 40/753 X |
| 5,007,608 | 4/1991 | Carroll, Jr. | 248/917 X |
| 5,094,513 | 3/1992 | Fukuda | 312/7.2 |
| 5,100,098 | 3/1992 | Hawkins | 248/917 |
| 5,329,712 | 7/1994 | Keller | 40/753 X |
| 5,359,374 | 10/1994 | Schwartz | 40/717 X |

FOREIGN PATENT DOCUMENTS

| | | | |
|---|---|---|---|
| 6133838 | 5/1994 | Japan | 40/717 |

*Primary Examiner*—Brian K. Green

[57] ABSTRACT

A picture frame system is provided. The picture frame system includes a housing in a rectangular configuration having an upper edge, a lower edge and parallel side edges therebetween. The housing has a front face and a rear face. A rectangular opening is formed in an upper extent of the front face thereof with a slit formed in one of the side edges adjacent to the front face and in alignment with the rectangular opening. A viewing screen is formed in the front face of the housing adjacent to the upper edge of the housing. Further provided is a photograph having a thin rectangular configuration and an area slightly larger than that of the rectangular opening. The photograph adapted to be removably situated within the slit such that the photograph resides between the rectangular opening and the viewing screen. A receptacle for receiving, storing, moving and playing an information storage media is provided. The receptacle is coupled with respect to the front face of the housing adjacent to the lower edge of the housing. Control means are provided to read the information storage media when in the receptacle and activated and to generate a picture on the screen.

5 Claims, 4 Drawing Sheets

FIG 1
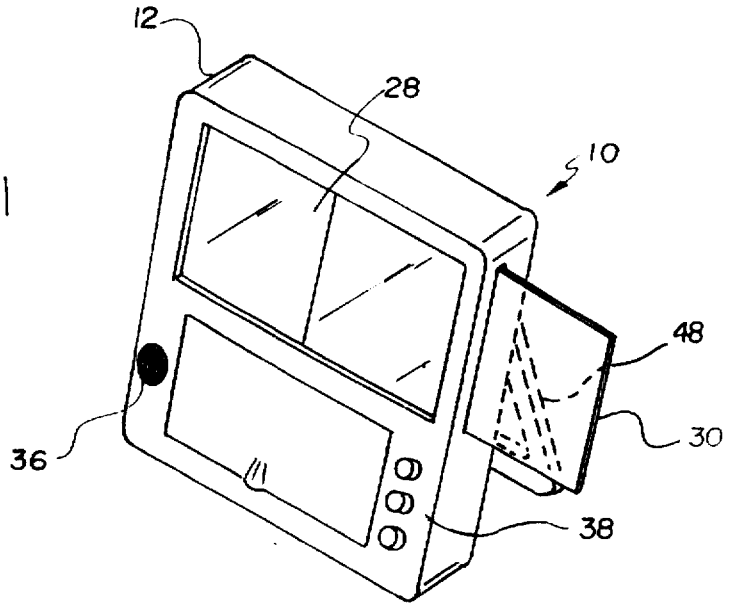
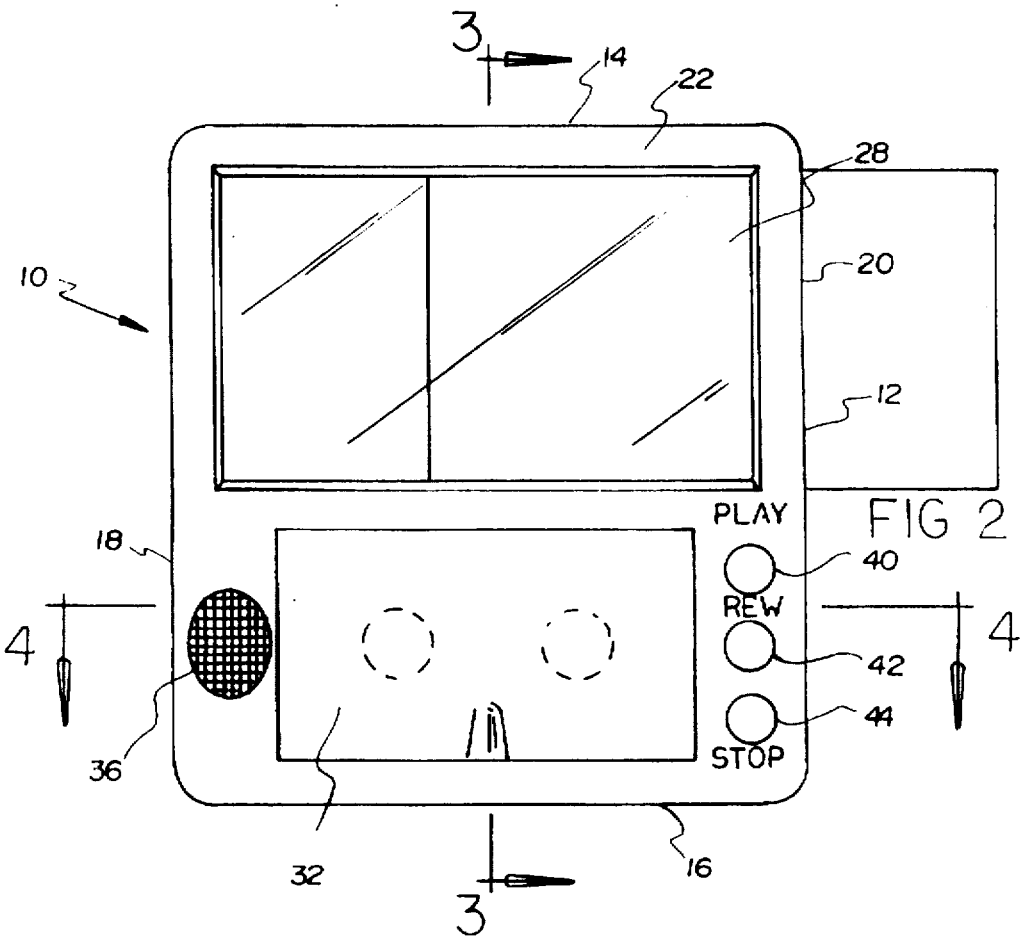
FIG 2

PICTURE FRAME SYSTEM

BACKGROUND OF THE INVENTION

1. Field of the Invention

The present invention relates to a picture frame system and, more particularly, pertains to providing sight and sound capabilities to a picture for viewer enjoyment.

2. Description of the Prior Art

The use of motion picture devices of various designs and configurations are known in the prior art. More specifically, motion picture devices of various designs and configurations heretofore devised and utilized for the purpose of entertaining viewers with pictures still and with motion, with and without sound through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,359,374 to Schwartz discloses talking picture frames.

U.S. Pat. No. 5,313,235 to Inoue et al discloses a sound playback apparatus capable of playing back sounds relevant to photographs.

U.S. Pat. No. 5,128,700 to Inoue et al discloses a camera capable of recording sound relevant to the photographing and apparatus for the playback of sounds.

U.S. Pat. No. 3,741,565 to Breitling et al discloses a talking photograph album.

U.S. Pat. No. 4,037,948 to Sakaguchi et al discloses a photographic camera which can use a film cartridge housing a film containing sound recording belt.

Lastly, U.S. Pat. No. 5,358,259 to Best discloses a talking video game.

In this respect, the picture frame system according to the present invention substantially departs from the conventional concepts and designs of the prior art, and in so doing provides an apparatus primarily developed for the purpose of providing sight and sound capabilities to a picture for viewer enjoyment.

Therefore, it can be appreciated that there exists a continuing need for new and improved picture frame system which can be used for providing sight and sound capabilities to a picture for viewer enjoyment. In this regard, the present invention substantially fulfills this need.

SUMMARY OF THE INVENTION

In view of the foregoing disadvantages inherent in the known types of motion picture devices now present in the prior art, the present invention provides an improved picture frame system. As such, the general purpose of the present invention, which will be described subsequently in greater detail, is to provide a new and improved picture frame system which has all the advantages of the prior art and none of the disadvantages.

To attain this, the present invention essentially comprises a new and improved picture frame system with motion and sound capabilities, comprising, in combination, a housing in a rectangular configuration having an upper edge, a lower edge and parallel side edges therebetween. The housing has a front face and a rear face. A rectangular opening is formed in an upper extent of the front face with a slit formed in one of the side edges adjacent to the front face. A viewing screen is formed in the front face of the housing adjacent to the upper edge of the housing. Also included is a photograph having a thin rectangular configuration and an area slightly larger than that of the rectangular opening. The photograph is adapted to be removably situated within the slit such that the photograph resides between the rectangular opening and the viewing screen. A receptacle for receiving, storing, moving and playing a video cassette is provided. The receptacle is coupled with respect to the front face of the housing adjacent to the lower edge of the housing. A speaker is formed in the front face of the housing laterally offset to the first side edge of the housing with a plurality of controls with buttons extending from the front face of the housing adjacent to the second side edge of the housing remote from the speaker. The controls include a play, a rewind and a stop button. The play button is adapted to transmit an activation signal upon the depression thereof. A pivotable support is secured to the rear face of the housing adapted to move between a retract position whereat the housing may be mounted on a wall and an extended position with the low end of the support remote from the housing wherein the housing may be retained in a generally vertical orientation on a support surface such as a table. Further provided is a control means adapted to effect the reading of the video cassette when activated upon the receipt of the activation signal, whereby upon being activated the control means effects both a sound through the speaker and a picture on the screen.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved picture frame system which has all the advantages of the prior art motion picture devices and none of the disadvantages.

It is another object of the present invention to provide a new and improved picture frame system which may be easily and efficiently manufactured and marketed.

It is a further object of the present invention to provide a new and improved picture frame system which is of a durable and reliable construction.

An even further object of the present invention is to provide a new and improved picture frame system which is susceptible of a low cost of manufacture with regard to both materials and labor, and which accordingly is then susceptible of low prices of sale to the consuming public, thereby making such picture frame system economically available to the buying public.

Still yet another object of the present invention is to provide a new and improved picture frame system which provides in the apparatuses and methods of the prior art some of the advantages thereof, while simultaneously overcoming some of the disadvantages normally associated therewith.

Still another object of the present invention is to provide sight and sound capabilities to a picture for viewer enjoyment.

Lastly, it is an object of the present invention to provide a new and improved picture frame system. The picture frame system includes a housing in a rectangular configuration having an upper edge, a lower edge and parallel side edges therebetween. The housing has a front face and a rear face. A rectangular opening is formed in an upper extent of the front face thereof with a slit formed in one of the side edges adjacent the front face and in alignment with the rectangular opening. A viewing screen is formed in the front face of the housing adjacent to the upper edge of the housing. Further provided is a photograph having a thin rectangular configuration and an area slightly larger than that of the rectangular opening. The photograph adapted to be removably situated within the slit such that the photograph resides between the rectangular opening and the viewing screen. A receptacle for receiving, storing, moving and playing an information storage media is provided. The receptacle is coupled with respect to the front face of the housing adjacent to the lower edge of the housing. Control means are provided to read the information storage media when in the receptacle and activated and to generate a picture on the screen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the picture frame system constructed in accordance with the principles of the present invention.

FIG. 2 is a front elevational view of the device shown in FIG. 1.

DESCRIPTION OF THE PREFERRED EMBODIMENT

Figure 3:
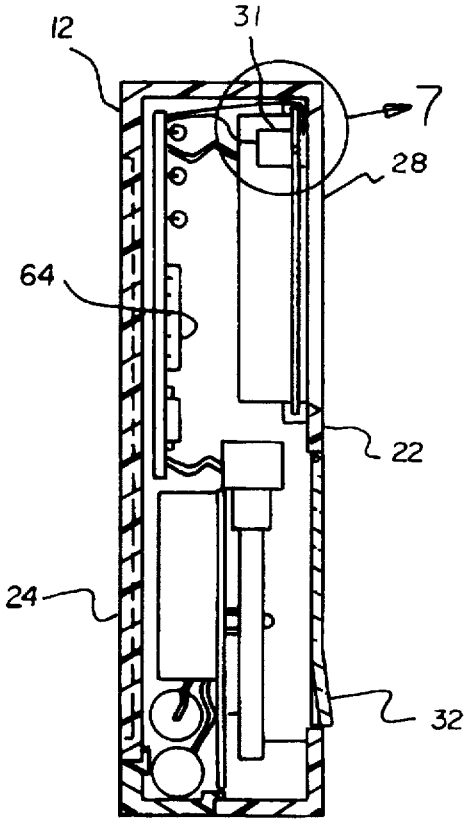
FIG. 3 is a cross sectional view taken along line 3—3 of FIG. 2.
Figure 4:
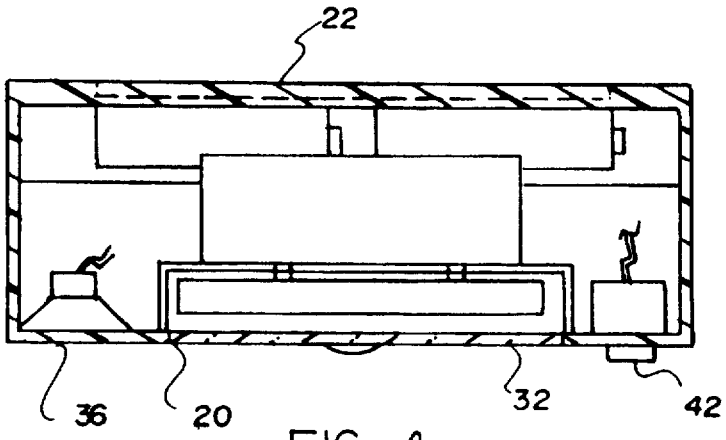
FIG. 4 is a cross sectional view taken along line 4—4 of FIG. 2.
Figure 5:
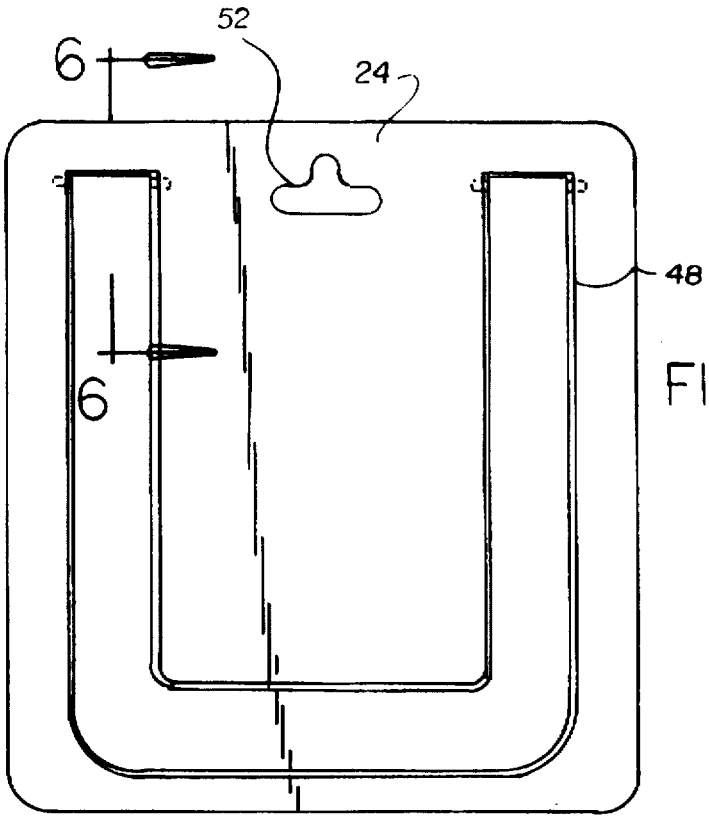
FIG. 5 is a rear elevational view of the system shown in the prior Figures.

With reference now to the drawings, and in particular to FIG. 1 thereof, a new and improved picture frame system embodying the principles and concepts of the present invention and generally designated by the reference numeral 10 will be described.

The present invention, the new and improved picture frame system, is comprised of a plurality of components. Such components in their broadest context include a housing, a viewing screen, a receptacle and control means. Such components are individually configured and correlated with respect to each other so as to attain the desired objective.

More specifically, the present invention may be construed as a system 10. The central component of such system is a housing 12. The housing is preferably formed in a rectangular configuration. It is formed to have an upper edge 14 and a lower edge 16. The upper and lower edges are parallel with each other. The housing also has parallel side edges including a first side edge 18 and a second side edge 20. The side edges are parallel with each other and perpendicular to the upper and lower edges. In addition, the housing has a front face 22 and a rear face 24. In order for the housing to resemble a picture frame, the depth thereof is constructed to be less than two inches. As shown in FIG. 1, a rectangular opening 26 is formed in an upper extent of the front face with a slit 27 formed in one of the side edges adjacent the front face and in alignment with the rectangular opening.

Coupled with respect to the housing and formed therein is a viewing screen 28. Such viewing screen is formed in the front face of the housing adjacent to the upper edge of the housing such that the screen may be viewed through the rectangular opening. As shown in FIG. 3, the viewing screen is situated within the housing and slightly spaced from the rectangular opening, thereby defining a slot 29. The viewing screen constitutes a majority of the extent of the front surface of the housing. Preferably, the display has a length of approximately five or eight inches and a width of approximately seven or ten inches.

Also included is a conventional photograph 30 having a thin rectangular configuration and an area slightly larger than that of the rectangular opening. The photograph is adapted to be removably situated within the slot via the slit such that the photograph resides between the rectangular opening and the viewing screen in a first orientation. The photograph may further be completely removed from the slot in a second orientation.

Figure 7:
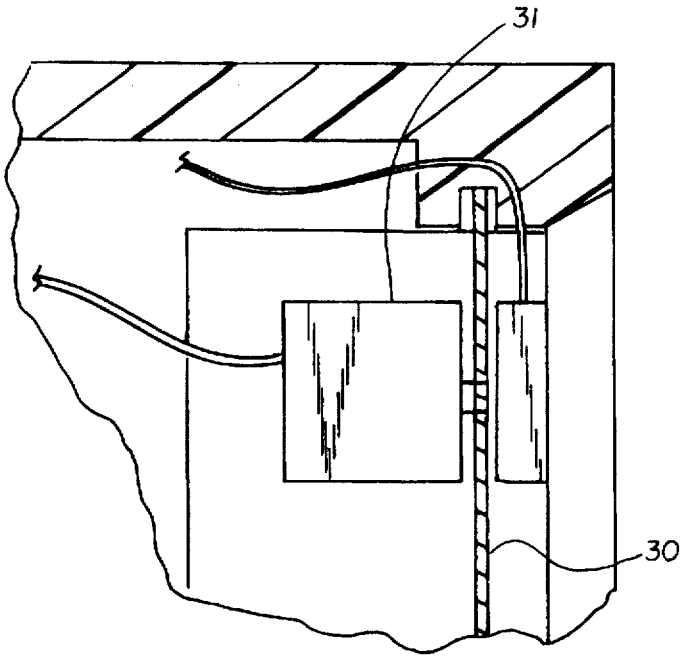
FIG. 7 is an exploded view of the photograph detection switch.
Figure 8:
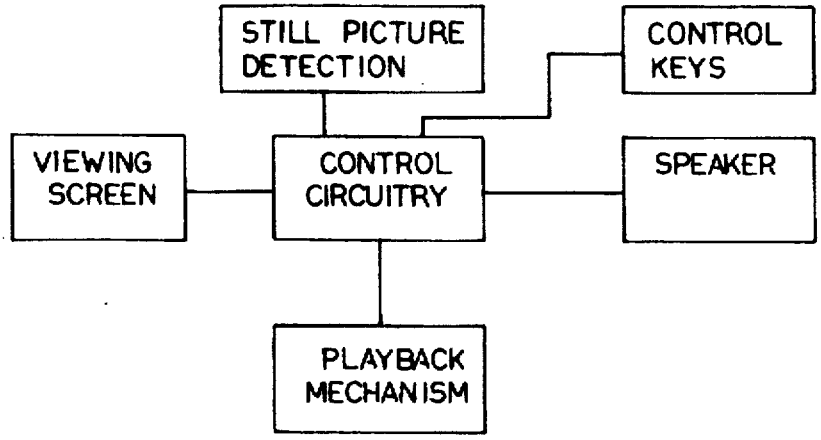
FIG. 8 is a schematic diagram depicting the various electrical components of the present invention.

As shown in FIGS. 3 & 7, a photograph detection switch 31 is included within the housing adjacent the slit. The photograph detection switch is adapted to emit an activation signal upon the removal of the photograph. As shown in FIG. 7, the switch has a first orientation when the photograph is inserted within the rectangular opening. In the first orientation, the activation signal is precluded from being transmitted. Upon 9/10 of the picture being removed from the rectangular opening, the switch is allowed to project to a second unbiased orientation in which the activation signal is transmitted. Optionally, the end of the switch may be bevelled to facilitate the insertion of the photograph.

Also forming a major portion of the front face of the housing is a receptacle 32. The receptacle is for receiving, storing, moving and playing a video cassette. It should be understood that other techniques and information storage media for receiving, storing and paying information, whether audio or video, could readily be utilized. Consider, for example, compact disks.

The receptacle is preferably coupled with respect to the front face of the housing. It is preferably located adjacent to the lower edge of the housing. The receptacle constitutes a major portion of the side of the housing in association with the viewing screen.

Also located on the housing but forming a smaller portion thereof is a speaker 36. It should be understood that plural speakers could be readily utilized as for example, to accommodate stereo phonic sound. The speaker is formed in the front face of the housing. It is laterally offset with respect to the first side edge of the housing. In addition, a plurality of controls are provided with buttons 38. Such buttons extend from the front face of the housing. They are located adjacent to the second side edge of the housing. They are on the side of the receptacle remote from the speaker. The controls are intended to include a play button 40, a rewind button 42 and a stop button 44. The play button is adapted to transmit an activation signal upon the depression thereof.

Figure 6:
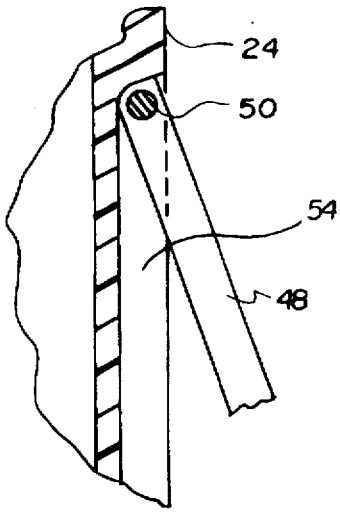
FIG. 6 is a cross sectional view taken along line 6—6 of FIG. 5.

In order to provide utility to the housing and other components of the system 10, there is provided a pivotable support 48. Such support is secured to the rear face of the housing as to a pivot pin 50. The support is adapted to move between a retracted position whereat the housing may be mounted on a wall via a slot 52. As shown in FIG. 6, the rear face of the housing has a recess 54 situated therein for ensuring that the pivotable support may be situated flush with the rear face. The support is also adapted to be moved to an extended position with the lower end of the support remote from the housing. In this orientation, the housing may be retained in a generally vertical orientation on a horizontal support surface such as a table. Additionally, an aperture may be centrally formed in the rear face of the housing for allowing the hanging thereof on a wall.

Lastly, electronic control means 64 are provided. Such electronic control means are adapted to effect the reading of the video cassette when activated upon the receipt of the activation signal. The activation signal may be transmitted by means of the photograph detection switch or the play button. In response to the reading of the cassette, there is generated both a sound through the speaker and a picture through the screen. The electronic control means is further adapted to selectively employ the speaker in order to play a song or jingle upon the first depression of the stop button during any moment of playback. Further, upon the first depression thereof, the stop button is specially designed to display a high-quality still picture. To disable the device, the stop button may again be depressed thus allowing the cassette to be removed. Rewinding of the cassette is effected upon the depression of the rewind button, the cessation of the cassette tape, or the detection via the photograph detection switch of the photograph being situated within the slot.

The present invention allows a user to place a conventional photograph therein for display. When a user wants to view a video cassette associated with the scene depicted on the photograph, the photograph may simply be removed thereby disclosing the viewing screen whereat the photograph detection switch signals the control means to play the video cassette. Upon the photograph being replaced, the video cassette is automatically rewound again via the photograph detection switch. It should be noted that the present invention may also be utilized without a photograph by simply utilizing the control buttons. At any moment during playback of the video cassette, the stop button may be utilized to effect a still picture and an associated jingle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved picture frame system with motion and sound capabilities, comprising, in combination:

a video cassette;

a housing in a rectangular configuration having an upper edge, a lower edge and parallel side edges therebetween, the housing having a front face and a rear face, the housing having a rectangular opening formed in an upper extent of the front face thereof and a slit formed in one of the side edges adjacent the front face and in alignment with the rectangular opening;

a viewing screen formed in the front face of the housing adjacent to the upper edge of the housing such that the screen may be viewed through the rectangular opening;

a photograph having a thin rectangular configuration and an area slightly larger than that of the rectangular opening, the photograph adapted to be removably situated within the slit such that the photograph resides between the rectangular opening and the viewing screen;

a photograph detection switch included within the housing adjacent the slit, the photograph detection switch adapted to emit an activation signal upon the removal of the photograph;

a receptacle for receiving, storing, moving and playing the video cassette, the receptacle coupled with respect to the front face of the housing adjacent to the lower edge of the housing;

a speaker formed in the front face of the housing laterally offset to a first side edge of the housing with a plurality of controls with buttons extending from the front face of the housing adjacent to a second side edge of the housing remote from the speaker, the controls including a play, a rewind and a stop button, the play button adapted to transmit an activation signal upon the depression thereof;

a pivotable support secured to the rear face of the housing adapted to move between a retract position whereat the housing may be mounted on a wall and an extended position with a low end of the support remote from the housing wherein the housing may be retained in a generally vertical orientation on a support surface; and control means to read the video cassette when in the receptacle and activated upon the receipt of the activation signal, whereby upon being activated the control means effects both a sound through the speaker and a picture on the screen.

2. A picture frame system comprising:

an information storage media;

a housing in a rectangular configuration having an upper edge, a lower edge and parallel side edges therebetween, the housing having a front face and a rear face, the housing having a rectangular opening formed in an upper extent of the front face thereof and a slit formed in one of the side edges adjacent the front face and in alignment with the rectangular opening;

a viewing screen formed in the front face of the housing adjacent to the upper edge of the housing;

a photograph having a thin rectangular configuration and an area slightly larger than that of the rectangular opening, the photograph adapted to be removably situated within the slit such that the photograph resides between the rectangular opening and the viewing screen;

a receptacle for receiving, storing, moving and playing the information storage media, the receptacle coupled with respect to the front face of the housing; and control means to read the information storage media when in the receptacle and activated and to generate a picture on the screen.

3. The picture frame system as set forth in claim 2 and further including:

a speaker formed in the front face of the housing laterally offset to a first side edge of the housing with a plurality of controls with buttons extending from the front face of the housing adjacent to a second side edge of the housing remote from the speaker, the controls including a play, a rewind and a stop button.

4. The picture frame system as set forth in claim 2 and further including:

a pivotable support secured to the rear face of the housing adapted to move between a retract position whereat the housing may be mounted on a wall and an extended position with a low end of the support remote from the housing wherein the housing may be retained in a generally vertical orientation on a support surface.

5. The picture frame system as set forth in claim 2 and further including:

a photograph detection switch included within the housing adjacent the slit, the photograph detection switch adapted to emit an activation signal upon the removal of the photograph, whereby upon the receipt of the activation signal, the control means effects both a sound through the speaker and a picture on the screen.

* * * * *